US008307952B2

(12) United States Patent
Fargo et al.

(10) Patent No.: US 8,307,952 B2
(45) Date of Patent: Nov. 13, 2012

(54) ELEVATOR SYSTEM WITH MULTIPLE CARS IN A HOISTWAY

(75) Inventors: Richard N. Fargo, Plainville, CT (US); Harold Terry, Avon, CT (US); Frank M. Sansevero, Bolton, CT (US); Boris Traktovenko, Avon, CT (US); John Milton-Benoit, West Suffield, CT (US); David Sirag, Ellington, CT (US); Arthur Hsu, South Glastonbury, CT (US); John Ferrisi, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 1097 days.

(21) Appl. No.: 11/720,337

(22) PCT Filed: Dec. 16, 2004

(86) PCT No.: PCT/US2004/042207

§ 371 (c)(1),
(2), (4) Date: Sep. 4, 2008

(87) PCT Pub. No.: WO2006/065241

PCT Pub. Date: Jun. 22, 2006

(65) Prior Publication Data

US 2009/0120724 A1 May 14, 2009

(51) Int. Cl.
*B66B 11/08* (2006.01)

(52) U.S. Cl. ..... 187/257; 187/251; 187/254

(58) Field of Classification Search ..... 187/249, 187/257

See application file for complete search history.

(56) References Cited

U.S. PATENT DOCUMENTS

| | | | | |
|---|---|---|---|---|
| 353,458 | A | 11/1886 | Murtaugh | |
| 849,840 | A | 4/1907 | Foster | |
| 974,439 | A | 11/1910 | Schwab | |
| 1,027,628 | A | 5/1912 | Schwab | |
| 1,805,227 | A * | 5/1931 | Rugg | 187/249 |

(Continued)

FOREIGN PATENT DOCUMENTS

EP 1371596 A1 12/2003

(Continued)

OTHER PUBLICATIONS

Supplementary Partial European Search Report for Application No. EP 04 81 4397 mailed Nov. 30, 2010.

(Continued)

*Primary Examiner* — Michael Mansen
*Assistant Examiner* — Michael Riegelman
(74) *Attorney, Agent, or Firm* — Carlson, Gaskey & Olds PC

(57) ABSTRACT

An elevator system (20) includes multiple elevator cars (22, 32) within a hoistway (26). Counterweights (24, 34) are associated with the respective elevator cars (22, 32) by load bearing members (40, 50). In some examples, different roping ratios are used for the load bearing members (40, 50). In some examples, the lengths of the load bearing members (40, 50) are selected to allow contact between the counterweights (24, 34) within the hoistway (26) and prevent contact between the elevator cars (22, 32). The difference in car and counterweight separation distances is greater than a stroke of a counterweight buffer plus an expected dynamic jump of the elevator cars. A disclosed example includes passages (80) through a portion of at least one of the elevator cars (22) for accommodating the load bearing member (50) of another elevator car (32) located beneath the elevator car (22) with the passages (80).

12 Claims, 6 Drawing Sheets

U.S. PATENT DOCUMENTS

| | | | | | |
|---|---|---|---|---|---|
| RE18,095 | E | | 6/1931 | Sprague | |
| 1,837,643 | A | * | 12/1931 | Anderson | 187/249 |
| 1,896,776 | A | * | 2/1933 | James | 187/249 |
| 1,896,777 | A | | 2/1933 | James | |
| 1,973,920 | A | * | 9/1934 | Wilson | 187/249 |
| 5,419,414 | A | | 5/1995 | Sakita | |
| 5,526,901 | A | * | 6/1996 | Salmon | 187/249 |
| 5,584,364 | A | | 12/1996 | Sakita | |
| 5,663,538 | A | | 9/1997 | Sakita | |
| 5,865,274 | A | | 2/1999 | Kiji et al. | |
| 5,877,462 | A | | 3/1999 | Chenais | |
| 6,273,217 | B1 | | 8/2001 | Hikita | |
| 6,360,849 | B1 | | 3/2002 | Hikita | |
| 6,364,065 | B1 | | 4/2002 | Hikita | |
| 6,554,107 | B2 | | 4/2003 | Yumura et al. | |
| 7,032,716 | B2 | | 4/2006 | Meyle et al. | |
| 7,117,979 | B2 | | 10/2006 | Angst et al. | |
| 7,178,635 | B2 | | 2/2007 | Meissner et al. | |
| 7,316,294 | B2 | * | 1/2008 | Mustalahti et al. | 187/249 |
| 7,819,228 | B2 | * | 10/2010 | Terry et al. | 187/249 |
| 7,857,103 | B2 | * | 12/2010 | Kocher | 187/249 |
| 2003/0075388 | A1 | | 4/2003 | Reuter et al. | |
| 2005/0082121 | A1 | | 4/2005 | Deplazes | |
| 2005/0087402 | A1 | | 4/2005 | Haegi et al. | |
| 2005/0279584 | A1 | | 12/2005 | Ruter et al. | |
| 2006/0289240 | A1 | | 12/2006 | Sakita | |
| 2007/0039785 | A1 | | 2/2007 | Smith et al. | |

FOREIGN PATENT DOCUMENTS

| | | | |
|---|---|---|---|
| EP | 1577250 | A1 | 9/2005 |
| EP | 1698580 | A1 | 9/2006 |
| EP | 1553040 | B1 | 8/2010 |
| JP | 59133188 | | 7/1984 |
| JP | 02106570 | | 4/1990 |
| JP | 4345486 | | 12/1992 |
| JP | 4361960 | | 12/1992 |
| JP | 5051185 | | 3/1993 |
| JP | 5132257 | | 5/1993 |
| JP | 6305648 | | 11/1994 |
| JP | 8133611 | | 5/1995 |
| JP | 7157243 | | 6/1995 |
| JP | 7172716 | | 7/1995 |
| JP | 8133630 | | 5/1996 |
| JP | 9110316 | | 4/1997 |
| JP | 2001226050 | | 8/2001 |
| JP | 2001240318 | | 9/2001 |
| JP | 2001247265 | | 9/2001 |
| JP | 2001251188 | | 9/2001 |
| JP | 2001335244 | | 12/2001 |
| JP | 2002220164 | | 8/2002 |
| JP | 2002255460 | | 9/2002 |
| JP | 2003160283 | | 6/2003 |
| JP | 2004002041 | | 1/2004 |
| JP | 2004155519 | | 6/2004 |

OTHER PUBLICATIONS

PCT International Preliminary Report on Patentability dated Jul. 13, 2007 for International application No. PCT/US04/42207.

PCT International Search Report and Written Opinion of the International Searching Authority mailed Sep. 26, 2006, for International application No. PCT/US04/42207.

* cited by examiner

ELEVATOR SYSTEM WITH MULTIPLE CARS IN A HOISTWAY

1. FIELD OF THE INVENTION

This invention generally relates to elevator systems. More particularly, this invention relates to an elevator system having more than one car in a hoistway.

2. DESCRIPTION OF THE RELATED ART

Many elevator systems include a car and counterweight coupled together by a rope or other load bearing member. A machine controls movement of the car to service passengers between various levels in a building, for example. As known, the counterweight and car typically move in opposite directions within a hoistway.

It has been proposed to include multiple elevator cars within a single hoistway. Such an arrangement provides advantages for increased or improved passenger service, for example. Example patents pertaining to elevator systems having multiple cars within a hoistway include U.S. Pat. Nos. 1,837,643; 1,896,776; 5,419,414; 5,584,364; and the published application U.S. 2003/0075388. Each of these shows a different arrangement of components within such an elevator system.

There are various challenges presented when trying to provide multiple cars in a hoistway. For example, it is necessary to control movement of the system components to avoid collisions between the elevator cars. It is also a challenge to arrange the counterweights and the load bearing members extending between the counterweights and the cars in a manner that efficiently uses hoistway space and does not require special modifications or undesirably large amounts of additional space.

This invention provides several techniques for arranging elevator system components to accommodate multiple cars in a hoistway.

SUMMARY OF THE INVENTION

One example elevator system designed according to this invention includes a first elevator car and a first counterweight in a hoistway. A first load bearing member has a first length and couples the first elevator car to the first counterweight. A second elevator car is in the hoistway below the first elevator car. A second counterweight is in the hoistway above the first counterweight. A second load bearing member has a second length and couples the second elevator car to the second counterweight. The lengths of the load bearing members (i.e., the first and second lengths) permit contact between the first and second counterweights but prevent contact between the first and second elevator cars.

By strategically selecting the lengths of the load bearing members and considering a counterweight buffer stroke plus an expected dynamic jump of the elevator cars, it is possible to avoid contact between elevator cars by always maintaining a spacing between them. In some examples, the dimensions of the counterweights and buffers associated with the counterweights are also selected to control the spacing between the elevator cars.

Another example elevator system includes a first elevator car, a first counterweight, a second elevator car and a second counterweight. The second elevator car is below the first elevator car. The second counterweight is above the first counterweight. Load bearing members coupling the respective elevator cars and counterweights have associated roping ratios that are different.

In one example, the first load bearing member that associates the first elevator car and first counterweight has an associated roping ratio of 1:1. The second load bearing member has an associated roping ratio of 2:1.

In another example elevator system designed according to this invention, the elevator car positioned above other elevator cars has at least one passage within an envelope of the cab portion through which at least a portion of the load bearing member associated with a lower elevator car passes.

The various features and advantages of this invention will become apparent to those skilled in the art from the following detailed description. The drawings that accompany the detailed description can be briefly described as follows.

DETAILED DESCRIPTION OF THE PREFERRED EMBODIMENTS

Figure 1:
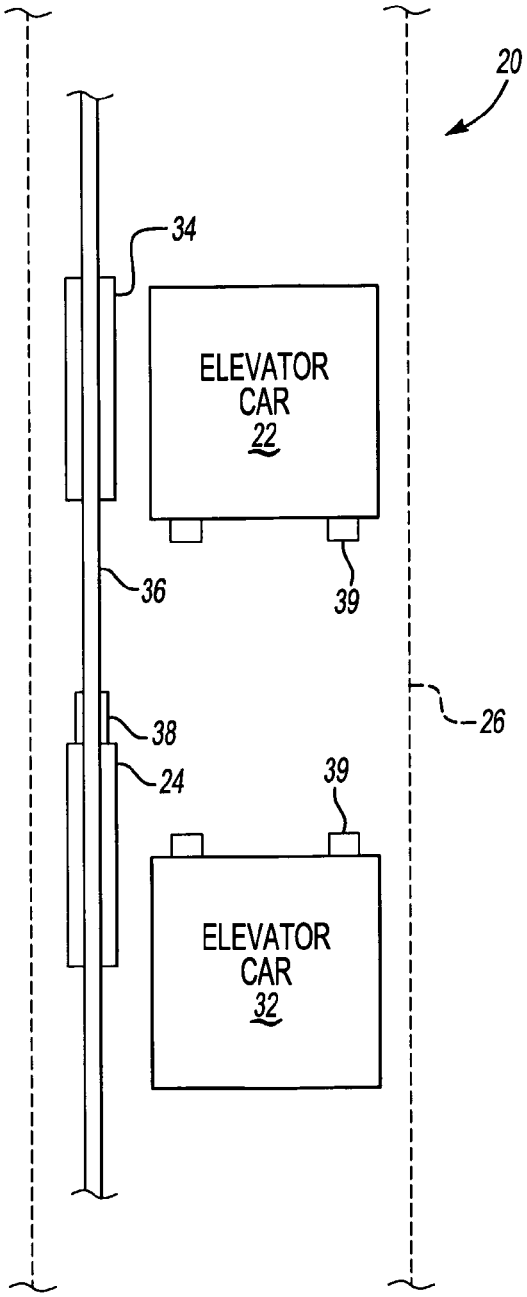
FIG. 1 schematically illustrates selected components of an elevator system having more than one elevator car in a hoistway.

FIG. 1 schematically shows selected portions of an elevator system 20. A first elevator car 22 is coupled with a first counterweight 24 for movement within a hoistway 26. Although not shown in FIG. 1, the first elevator car 22 is coupled to the first counterweight 24 by a plurality of ropes or belts as known. For purposes of this description, "a load bearing member" should be understood to mean one or more ropes or belts. A second elevator car 32 is positioned below (according to the drawing) the first elevator car 22. The second elevator car 32 is associated with a second counterweight 34 by a load bearing member (not shown) so that both move within the hoistway 26 as known.

In this example, the counterweights 24 and 34 travel along common guiderails 36. In other words, the counterweights 24 and 34 share the same guiderails.

Another feature of the system 20 schematically shown in FIG. 1 is that at least one buffer 38 is supported on at least one of the counterweights 24 and 34 to absorb impact associated with the counterweights contacting each other. The buffer 38 in one example is partially supported within the envelope of the counterweight. A set of relatively smaller bumpers 39 are provided on at least one of the cars 22, 32.

Various features of such an elevator system are described in connection with the various example embodiments described below. For example, load bearing members, such as ropes or belts couple the elevator cars and counterweights, respectively. One feature of one example system designed according to this invention includes selecting lengths of the load bearing members and considering a buffer stroke of the counterweight buffer 38 and an expected dynamic jump of the elevator cars 22 and 32 to allow contact between the counterweights or associated buffers within the hoistway and to prevent contact between the elevator cars. The resulting difference in car and counterweight separation distances is greater than the counterweight buffer stroke plus the expected dynamic jump of the elevator cars. Given this description, those skilled in the art will realize how car speeds, buffer strokes, component sizes, etc., will combine to meet their particular needs. In some examples, the lengths of the load bearing members and their association with the elevator system components ensure that the elevator cars will never contact each other under normal system operating conditions. Such an arrangement also provides, for example, for adequate overhead clearance above a car that is positioned beneath another car for maintenance or inspection procedures.

In the event that counterweight jump or overspeed conditions result in contact between the cars 22 and 32, the buffers 39 absorb some of the energy associated with such an impact.

Another feature of an example elevator system designed according to this invention is that a first roping ratio for one elevator car and counterweight is different than a second roping ratio for the other elevator car and counterweight. Depending on the selection of roping ratios, different features may be incorporated into an elevator system designed according to this invention. Such features will be described in connection with corresponding examples to be discussed below.

In some example systems designed according to this invention, the roping placement strategy includes allowing for some of the load bearing members to pass through a passage associated with at least an upper elevator car. Such passages allow for using various roping ratios, for example, while still maintaining space limitations on a hoistway.

A variety of combinations of such features may be used depending on the needs of a particular situation. Given this description, those skilled in the art will be able to determine how best to combine the disclosed features to meet the needs of their particular situation.

Figure 2A:
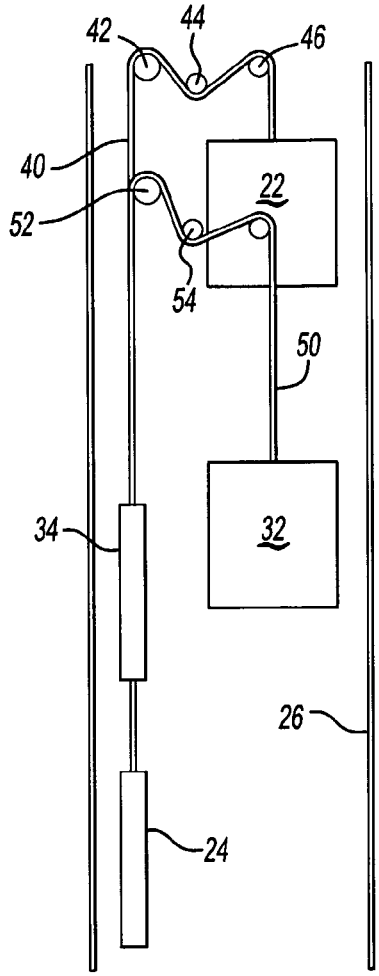
FIGS. 2A and 2B schematically illustrate one example elevator system configuration.
Figure 2B:
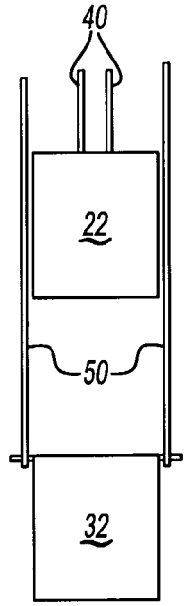

FIGS. 2A and 2B schematically show one example elevator system configuration. In this example, the first elevator car 22 is coupled to the first counterweight 24 by a load bearing member 40. A drive sheave or traction sheave 42 causes movement of the load bearing member 40 to cause the desired movement of the elevator car 22 in a known manner. Deflector sheaves 44 and 46 are included in the illustration to show how the load bearing member 40 is routed within the hoistway to accommodate both elevator cars and to achieve a desired angle of wrap around the drive sheave 42.

The second elevator car 32 is coupled to the second counterweight 34 by a load bearing member 50. A separate drive sheave 52 and deflector sheaves 54 are included for routing the second load bearing member 50.

As can be appreciated from FIG. 2A, both of the load bearing members 40 and 50 have an associated roping ratio that is 1:1. In this example, the length of the first load bearing member 40 is selected based upon the combined length of the second load bearing member 50 and the second counterweight 34 so that the counterweights 24 and 34 will contact each other before the elevator cars 22 and 32 are able to contact each other. In other words, the length of the first load bearing member 40 is selected to prevent contact between the elevator cars 22 and 32. In one example, the length of the load bearing member 40 will be less than a combined length of the second load bearing member 50 and a distance between a bottom of the counterweight 34 and a termination of the load bearing member 50 associated with the counterweight 34. Where a buffer 38 is included between the counterweights, the size or stroke length of the buffer is also considered when selecting the length of the load bearing member 40.

FIG. 2A shows this example arrangement from the side while FIG. 2B shows the arrangement from the front (focusing only on the elevator cars 22 and 32). The counterweights 34 and 24 are behind the cars 22 in this example.

The second load bearing member 50 is effectively "split" and some belts or ropes are provided on one side of the car 32 while other belts or ropes are provided on another side of the car 32. In the example of FIG. 2B, the load bearing members 50 are on the outside of the elevator car 22.

Figure 3A:
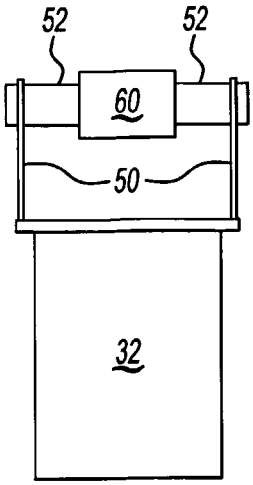
FIGS. 3A and 3B schematically illustrate two roping strategy examples.
Figure 3B:
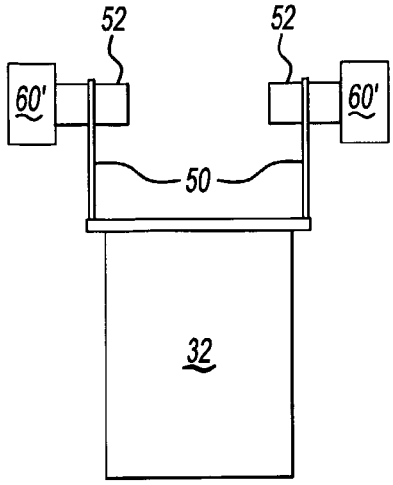

FIGS. 3A and 3B schematically show two strategies for routing load bearing members where some of them are one side of an elevator car and others are on an opposite side. In the example of FIG. 3A, a single drive machine 60 is associated with drive sheaves 52 to cause desired movement of the load bearing member 50 and the elevator car 32. In the example of FIG. 3B, independent drive machines (not illustrated) operate drive sheaves 52 to cause desired car movement.

Figure 4A:
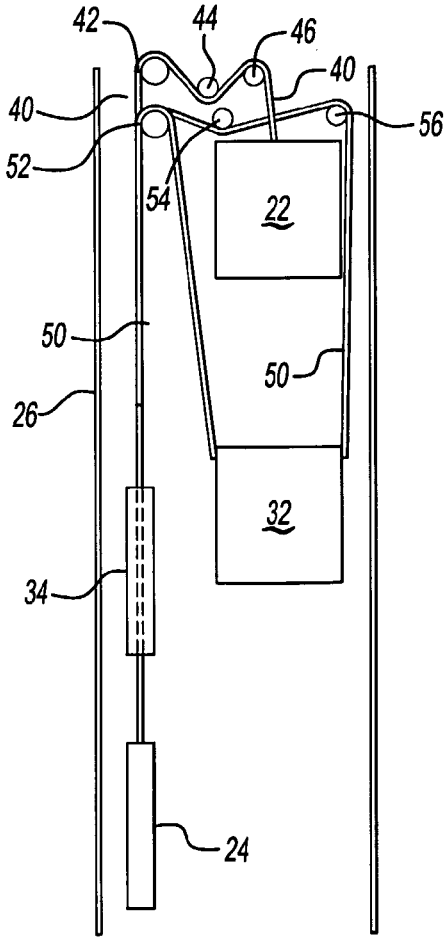
FIGS. 4A and 4B schematically illustrate another example elevator system configuration.
Figure 4B:
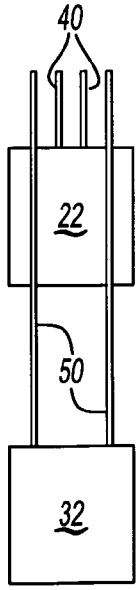

FIGS. 4A and 4B show another example elevator system where the load bearing members 40 and 50 each have an associated roping ratio of 1:1. In this example, the counterweights 24 and 34 are positioned along the side of the elevator cars 22 and 32. The illustration of FIG. 4A is a front view while the illustration of FIG. 4B is a side view (showing only the cars and portions of the load bearing members). In this example, the deflector sheaves 54 and 56 are only used for some of the second load bearing member belts or ropes 50 (i.e., those extending from the right side of the car 32 according to the drawing). This allows for routing the load bearing members around the elevator car 22 to achieve the side-positioned counterweight arrangement.

Figure 5A:
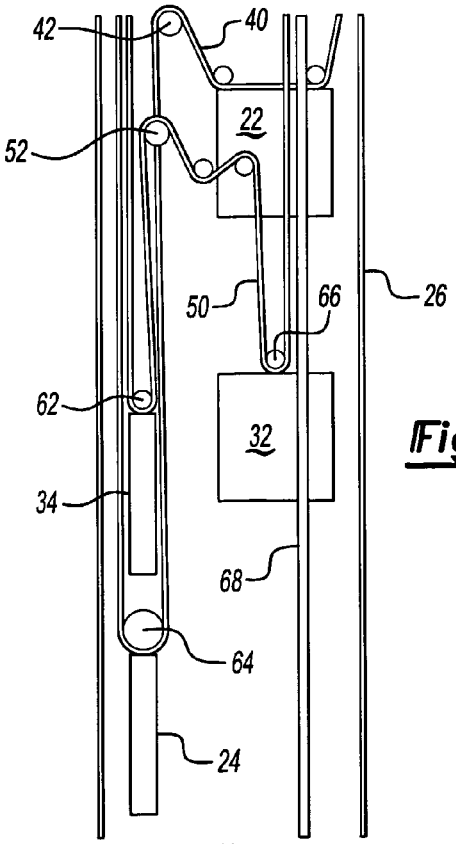
FIGS. 5A and 5B schematically illustrate another elevator system configuration.
Figure 5B:
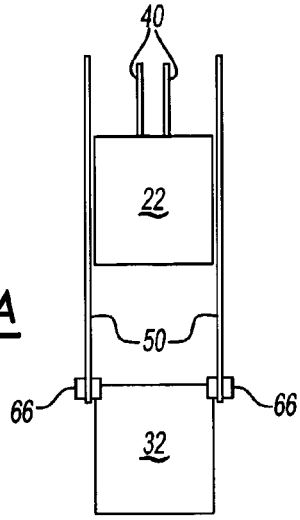

FIGS. 5A and 5B schematically show another elevator system configuration where the load bearing members 40 and 50 each have an associated roping ratio of 2:1. FIG. 5A is a side view while FIG. 5B is a front view. The counterweights 24 and 34 are located behind the cars 22 and 32 in this example.

One feature of an arrangement where the first load bearing member 40 has a 2:1 roping ratio is that it is possible to have the load bearing member 40 outside of oppositely facing surfaces on the second counterweight 34. In this example, a deflector sheave 62 travels with the second counterweight 34 through the hoistway. Another deflector sheave 64 travels with the first counterweight 24. In this example, a diameter of the deflector sheave 64 is selected to be larger than an outside dimension of the second counterweight 34 such that the load bearing member 40 is guided outside of the oppositely facing surfaces (i.e., the right and left sides of the counterweight 34 in FIG. 5A). Such an arrangement is possible whenever the first load bearing member 40 coupling the first elevator car 22 to the first counterweight 24 has associated roping ratio of 2:1. Such an arrangement is possible regardless of whether the second load bearing member 50 has an associated roping ratio of 2:1.

Another feature of the example in FIGS. 5A and 5B is that deflector sheaves 66 that travel with the second elevator car 32 are positioned relative to the car so that the load bearing member 50 is entirely on one side of a car guiderail 68. In this example, the car guiderail 68 is aligned offset from the center of gravity of the elevator cars 22 and 32. It may not be possible to center the car guiderail 68 in such an arrangement. Both of the sets of ropes or belts of the load bearing member 50 are behind the rail 68 in the illustration. The example of FIG. 2A, by contrast, may have one of the sides of the load bearing member 50 (i.e., the rope or belt associated with one side of the car 32) positioned on one side of the car guiderail with the others (i.e., those associated with an opposite side of the car 32) positioned on an opposite side of the car guiderail. Such a roping arrangement makes it easier to have the car guiderail centered relative to the center of gravity of the elevator cars.

Figure 6A:
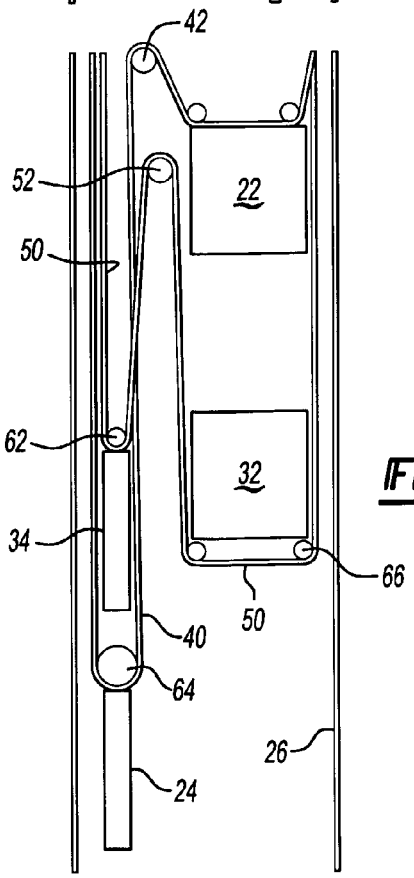
FIGS. 6A and 6B schematically illustrate another example elevator system configuration.
Figure 6B:
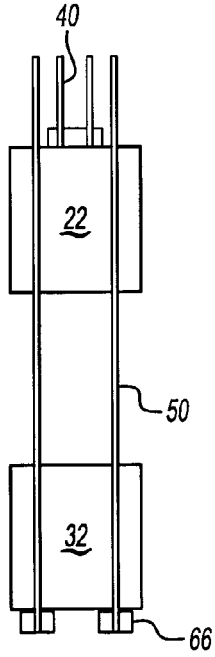

FIGS. 6A and 6B schematically illustrate another elevator system configuration where both load bearing members 40 and 50 have an associated 2:1 roping ratio. In this example, the counterweights 34 and 24 are supported on the side of the cars 22 and 32.

Whenever at least one of the load bearing members has a 2:1 roping ratio, it is possible to position the drive sheaves, drive machines or both at the same vertical position or height in a hoistway or machine room.

Figure 7A:
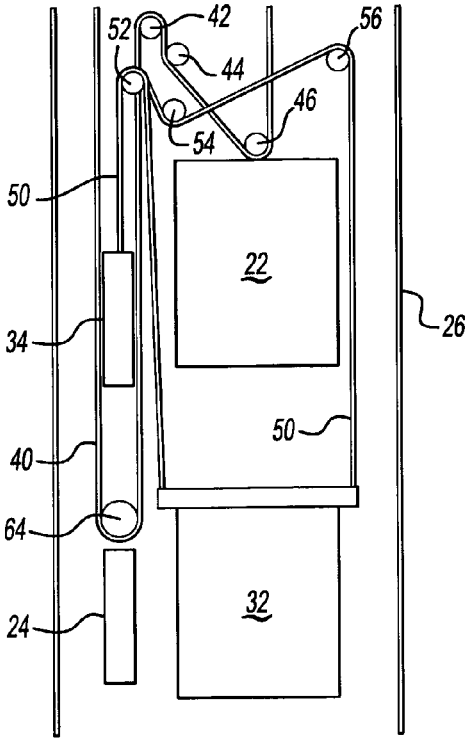
FIGS. 7A-7C schematically illustrate another example elevator system configuration.
Figure 7B:
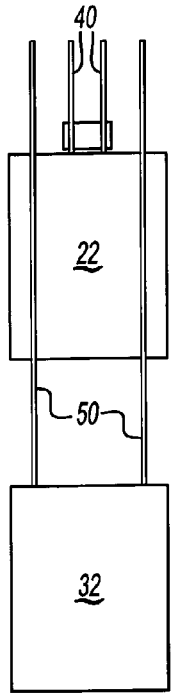
Figure 7C:
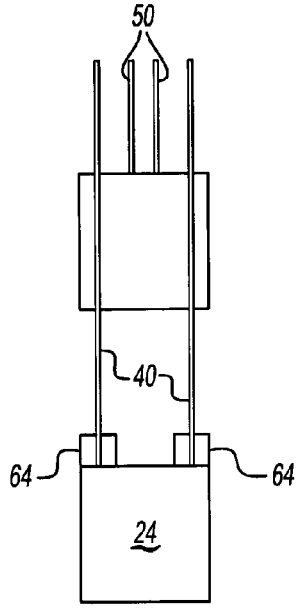

FIGS. 7A-7C schematically show another example elevator system configuration. In this example, the load bearing member 50 associated with the second elevator car 32 and the second counterweight 34 has an associated roping ratio that is 1:1. The first load bearing member 40 has a roping ratio of 2:1. In this example, the roping ratios of the load bearing members are different. It can be appreciated from FIG. 7A, for example, that the use of a sufficiently large deflector sheave 64 associated with the counterweight 24 allows for the load bearing member 40 to be on the outside of oppositely facing outside surfaces of the second counterweight 34. In this example, some of the ropes or belts for the load bearing member 50 travel about deflector sheaves 54 and 56 while others do not. This allows for routing the belts or ropes around the outside of the first elevator car 22. The counterweights 34 and 24 are on the side of the elevator cars 22 and 34.

Figure 8A:
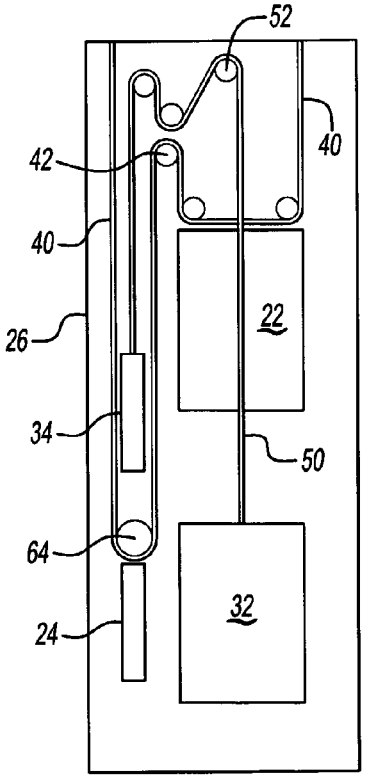
FIGS. 8A-8C schematically illustrate another example elevator system configuration.
Figure 8B:
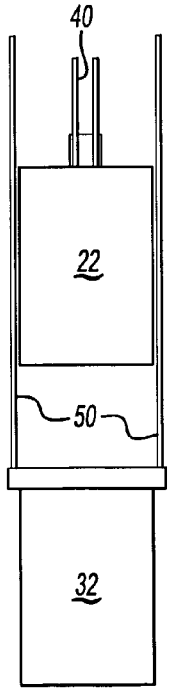
Figure 8C:
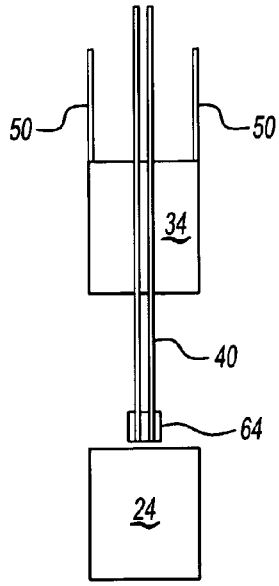

FIGS. 8A-8C schematically illustrate another example elevator system configuration where the first load bearing member 40 has an associated roping ratio of 2:1 and the second load bearing member 50 has an associated roping ratio of 1:1. In the example of FIGS. 8A-8C, the counterweights 34 and 24 are located behind the elevator cars 22 and 32.

Figure 9A:
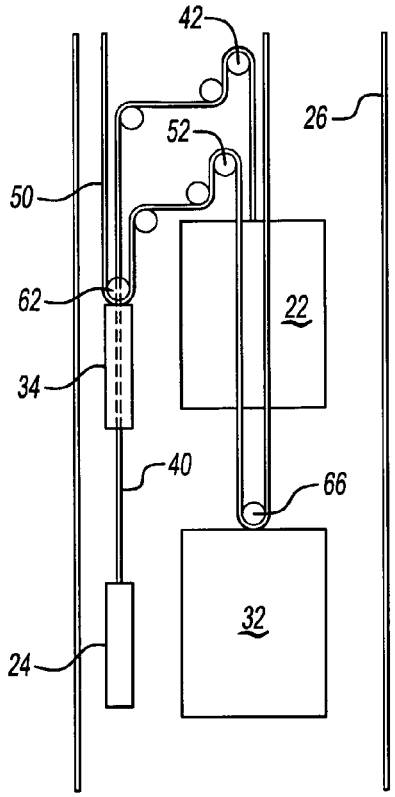
FIGS. 9A-9C schematically illustrate another example elevator system configuration.
Figure 9B:
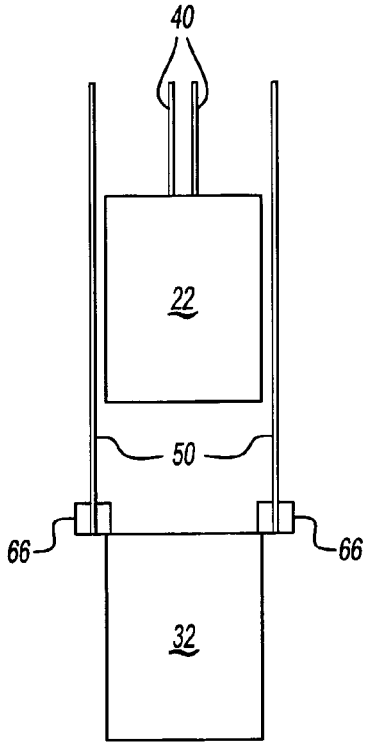
Figure 9C:
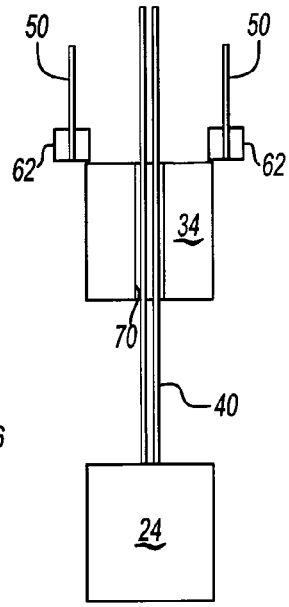

FIGS. 9A-9C schematically show another elevator system configuration. In this example, the first load bearing member 40 has an associated roping ratio of 1:1. The second load bearing member 50 has an associated roping ratio of 2:1.

Another feature of this example configuration is that the second counterweight 34 includes a passage 70, which comprises an opening through a central portion of the second counterweight 34 in this example. The passage 70 allows for the first loading bearing member 40 to pass through the second counterweight 34. Such an arrangement may provide space savings, for example.

In the examples of FIGS. 9A-9C, the counterweights 34 and 24 are located behind the elevator cars 22 and 32.

Figure 10A:
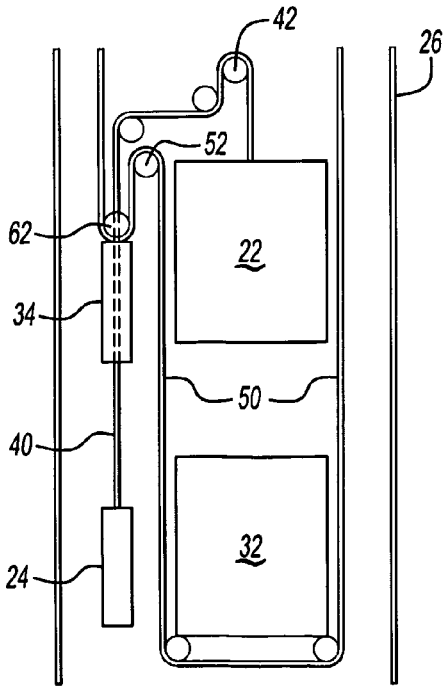
FIGS. 10A-10C schematically illustrate another example elevator system configuration.
Figure 10B:
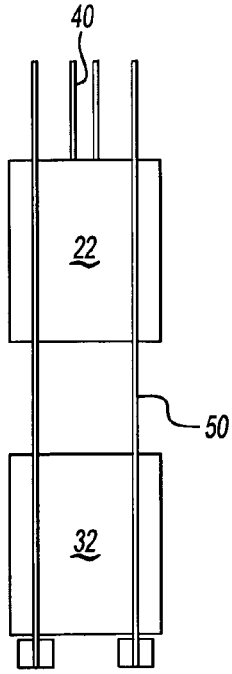
Figure 10C:
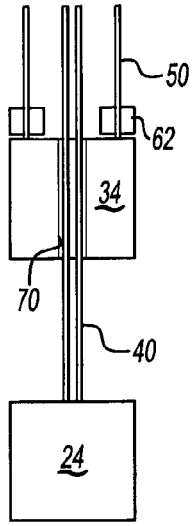

Another example arrangement where the first load bearing member 40 has a 1:1 roping ratio and the second load bearing member 50 has a 2:1 roping ratio is shown in FIGS. 10A-10C. In this example, the second counterweight 34 and the first counterweight 24 are located on the side of the elevator cars 22 and 32. This example also includes a passage 70 through the second counterweight 34.

Configuring an elevator system as schematically shown in FIGS. 10A-10C may be considered the most optimum solution for some situations because it requires the fewest number of sheaves near the top of the hoistway and it is possible to have the first load bearing member 40 pass through the passage 70 in the second counterweight 34. Such an elevator system configuration may be preferred where space savings is a primary consideration, for example.

Figure 11A:
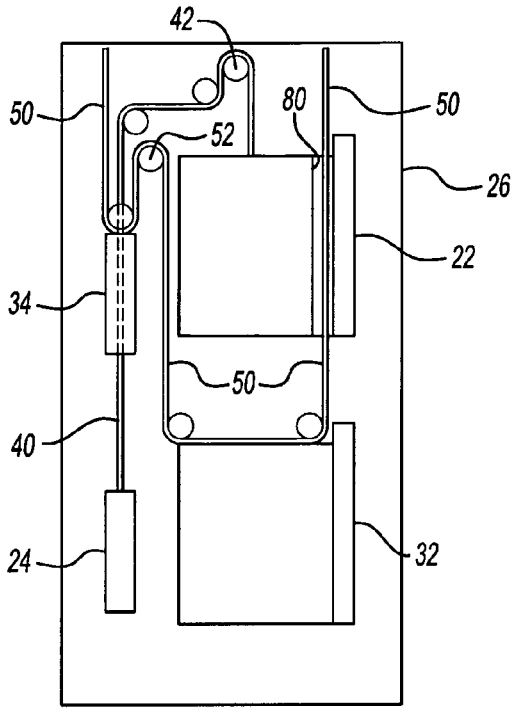
FIGS. 11A-11C schematically illustrate an elevator cab feature used in conjunction with one example roping strategy.
Figure 11B:
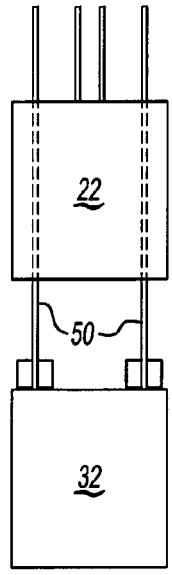
Figure 11C:
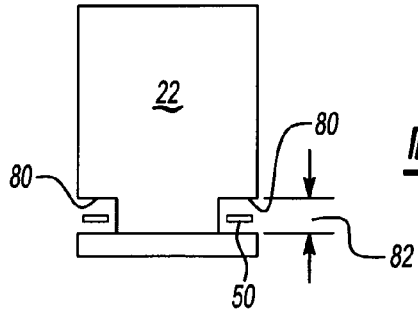

FIGS. 11A-11C schematically show another elevator system configuration. In this example, the first load bearing member 40 has an associated roping ratio of 1:1. The second load bearing member 50 has an associated roping ratio of 2:1. The portion of the second load bearing member 50 belts or ropes that extend between the second elevator car 32 and a top of the hoistway 26 pass through passages 80 on the elevator car 22. In the illustrated example, the passages 80 have a dimension shown at 82 that is large enough for the belts or ropes of the second load bearing member 50 to be accommodated through the passage 80. In this example, the load bearing member 50 has an associated roping ratio of 2:1. Accordingly, whenever the first elevator car 22 is stationary, there is no relative movement between the load bearing member 50 within the passage 80 and the first elevator car 22 even when the second elevator car 32 is moving.

Having passages 80 on an elevator car 22 allows for space savings within a hoistway because the ropes or belts of the load bearing member 50 need not be routed on the outside of the elevator car 22.

As can be appreciated from FIG. 11C, the passages 80 fit within an envelope of a passenger cab portion of the example first elevator car 22. Although not illustrated, the elevator cars include a frame and a cab portion supported on the frame in a known manner. The cab portion has an outside envelope and defines the space within which passengers are carried by the elevator system. In this example, the passages 80 preferably fit within the envelope of the elevator cab portion.

Figure 12:
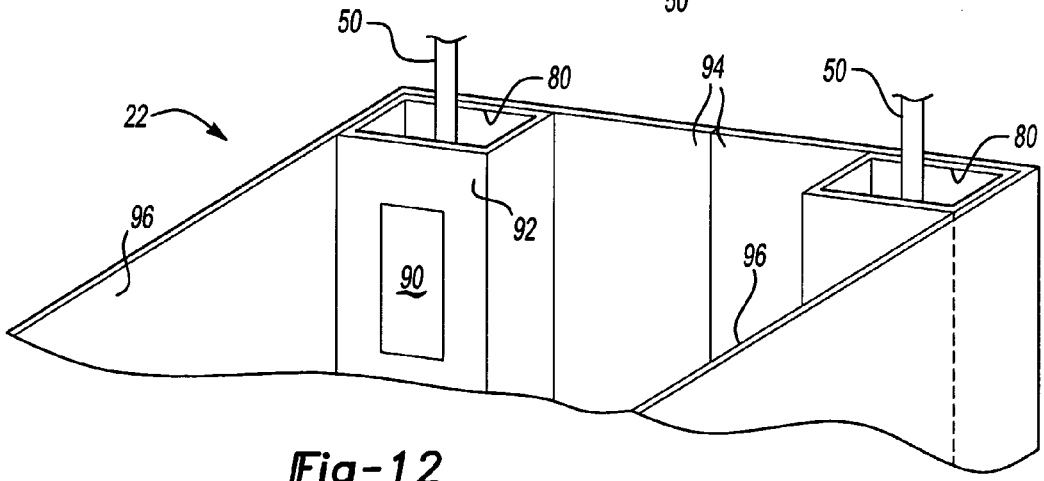
FIG. 12 schematically shows somewhat more detail of one example arrangement consistent with the embodiment of FIGS. 11A-11C.

FIG. 12 schematically shows one arrangement where the passages 80 are associated with a portion of the cab that normally accommodates an elevator car operating panel 90. In this example, at least one internal sidewall 92 of the elevator car supports the car operating panel 90, which includes a touch screen or buttons accessible by a passenger on one side of the sidewall 92. An opposite side of the sidewall 92 (i.e., an outwardly facing side relative to the interior of the cab) faces the interior of the passage 80. By accommodating the belts or ropes of the load bearing member 50 within a space adjacent to or associated with the space used to accommodate a car operating panel 90, space-savings within a hoistway can be achieved without sacrificing a significant amount of additional capacity within the interior of the elevator car cab portion.

The various examples shown above illustrate elevator system configurations having strategically sized load bearing members, various combinations of roping ratios and various features for realizing optimum space usage, minimizing the number of components required or both. Given this description, those skilled in the art will be able to select what combination of features will work best for their particular situation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a first elevator car in a hoistway;

a first counterweight in the hoistway;

a first load bearing member having a first length and coupling the first elevator car to the first counterweight;

a second elevator car in the hoistway below the first elevator car;

a second counterweight in the hoistway above the first counterweight; and a second load bearing member having a second length and coupling the second elevator car to the second counterweight, at least the first and second lengths permitting contact between the first and second counterweights and preventing contact between the first and second elevator cars.

2. The elevator system of claim 1, wherein the first and second lengths are such that a distance between a contact surface near a bottom of the second counterweight and a contact surface near a top of the first counterweight is less than a distance between potential contact surfaces of the first and second elevator cars.

3. The elevator system of claim 1, wherein the first load bearing member has an associated first roping ratio and the second load bearing member has an associated second, different roping ratio.

4. The elevator system of claim 3, wherein the first roping ratio is 1:1 and the second roping ratio is 2:1.

5. The elevator system of claim 3, wherein the first roping ratio is 2:1 and the elevator cars have a front side, a back side and lateral sides and wherein the counterweights are positioned along one of the lateral sides.

6. The elevator system of claim 1, including a first machine for moving the first elevator car and a second machine for moving the second elevator car and wherein at least one of the first or second load bearing members is has an associated 2:1 roping ratio and the first and second machines are at the same general vertical location relative to the hoistway.

7. The elevator system of claim 1, including guide rails for guiding movement of the first and second counterweights, wherein the second counterweight has oppositely facing sides that face the guide rails and oppositely facing outside surfaces facing generally perpendicular to the sides, wherein the first load bearing member has an associated 2:1 roping ratio and a portion of the first load bearing member is positioned outside each of the outside surfaces.

8. The elevator system of claim 7, including at least one sheave associated with the first counterweight about which the first load bearing member travels and wherein the sheave provides a spacing between portions of the first load bearing member that is greater than a distance between the outside surfaces.

9. The elevator system of claim 1, wherein the first elevator car has a passenger cab portion that includes at least one passage through which at least a portion of the second load bearing member passes.

10. The elevator system of claim 1, including at least one buffer supported to move with a selected one of the counterweights, the buffer being at least partially positioned between the counterweights and wherein the first length is selected at least in part based on a characteristic of the buffer.

11. The elevator system of claim 1, wherein the second load bearing member includes a first elongated member along one side of the first elevator car and a second elongated member along an oppositely facing side of the first elevator car and including a first drive sheave for moving the first elongated member, a second drive sheave for the second elongated member and at least one motor for moving the drive sheaves.

12. The elevator system of claim 11, including a first motor for moving the first drive sheave and a second motor for moving the second drive sheave.

* * * * *